United States Patent [19]

Kells

[11] 4,014,178

[45] Mar. 29, 1977

[54] REFRIGERATOR TEMPERATURE CONTROLS

[76] Inventor: John D. Kells, 1678 71st St., Brooklyn, N.Y. 11204

[22] Filed: May 3, 1976

[21] Appl. No.: 682,569

[52] U.S. Cl. ..... 62/3; 62/441; 62/442; 62/125

[51] Int. Cl.[2] ..... F25B 21/02; F25B 49/00; F25D 11/02; F25D 13/02

[58] Field of Search ..... 62/3, 441, 442, 531, 62/DIG. 3, 161, 203, 125

[56] References Cited

UNITED STATES PATENTS

| | | | |
|---|---|---|---|
| 1,963,625 | 6/1934 | Lassifer, Jr. et al. | 62/125 |
| 2,251,736 | 8/1941 | Hill | 62/442 |
| 2,518,242 | 8/1950 | McMahon | 62/441 |
| 3,359,751 | 12/1967 | Stevens | 62/441 |
| 3,478,536 | 11/1969 | Kohya et al. | 62/441 |

*Primary Examiner*—Lloyd L. King
*Attorney, Agent, or Firm*—Richard L. Miller

[57] ABSTRACT

A refrigerator principally for home use, the refrigerator having a temperature control panel on the front exterior thereof for indicating and regulating the temperatures within both the freezer and cool compartments, thus readily providing means for observing and controlling the existing temperatures therein, and eliminating the necessity of opening the refrigerator doors for ascertaining and adjusting internal refrigerator temperatures to efficient and desirable levels.

3 Claims, 4 Drawing Figures

REFRIGERATOR TEMPERATURE CONTROLS

This invention relates generally to domestic type refrigerators such as are usually installed in a kitchen and having separate compartments, a freezer compartment to accommodate frozen foods, and a cool compartment for storing refrigerated foods at a slightly lower temperature than that of the freezer compartment. While this presentation of the invention describes and illustrates a useful modification of a refrigerator of the above type, it is of course equally applicable to refrigerators embodying a single compartment, either a freezer compartment or a cool compartment, by providing a single external control in place of the twin external controls herein illustrated and described.

In all conventional such refrigerators, the thermostat controls for regulating the temperatures of the cool and freezer compartments are located within the interior of the refrigerator so that it is necessary to open the door of the refrigerator for checking or adjusting temperatures within same. This is objectionable because such excess opening of the door causes a loss of cooling effect within the refrigerator compartments. This situation is accordingly in want of an improvement.

Therefore, it is a principal object of the present invention to provide a refrigerator wherein the temperature controls are located on an exterior thereof so as to be visible or adjusted without the necessity of opening a refrigerator door.

Another object is to provide refrigerator temperature controls which can be located between a cool compartment and freezer compartment doors so that the control knobs are recessed therebetween and do not project forwardly further than a front side of the doors thus minimizing the possibility of touching the same and accidently moving the dial knobs to a different setting.

Other objects are to provide refrigerator temperature controls which are simple in design, inexpensive to manufacture, rugged in construction, easy to use and efficient in operation.

Further objects of the invention will appear as the description proceeds.

To the accomplishment of the above and related objects this invention may be embodied in the form illustrated in the accompanying drawings, attention being called to the fact, however, that the drawings are illustrative only, and that changes may be made in the specific construction illustrated and described within the scope of the appended claims.

Figure 1:
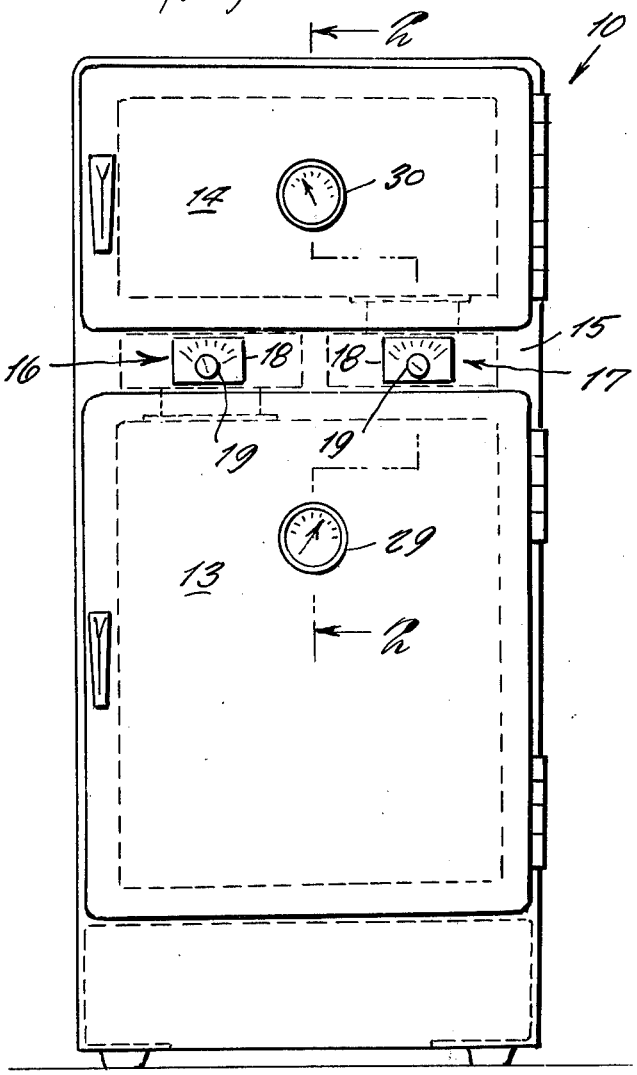
FIG. 1 is a front view of a refrigerator shown incorporating the present invention.
Figure 2:
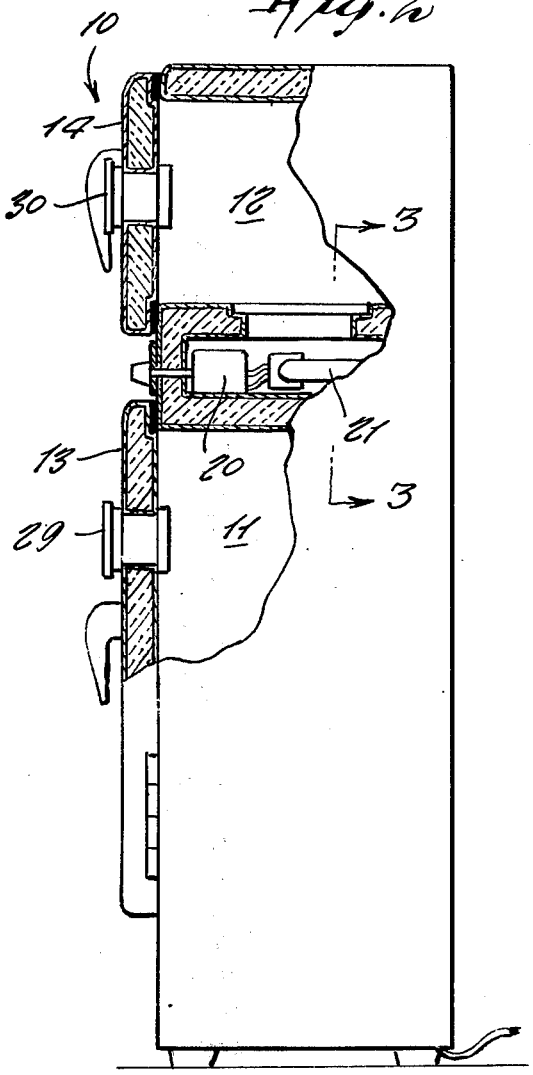
FIG. 2 is a side view thereof shown partly in cross section, as viewed on line 2—2 of FIG. 1.
Figure 3:
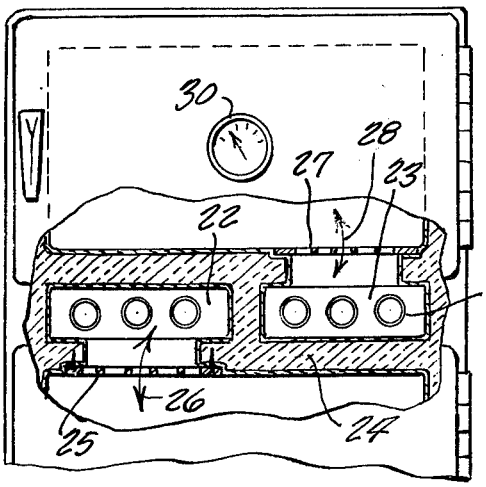
FIG. 3 is a cross sectional view taken on line 3—3 of FIG. 2.

Referring now to the drawing FIGS. 1 to 3 in greater detail, the reference numeral 10 represents a refrigerator according to the present invention wherein the same includes a cool compartment 11 for keeping foods cool above a freezing temperature, and a freezer compartment 12 for keeping foods frozen, and which are closed by separate front doors 13 and 14 respectively.

The replenishing cold air supplied from the refrigerating mechanism to the compartments 11 and 12, enters those compartments through conventional internal ducts in the refrigerator structure, and not through or by way of the thermostat chamber 22 nor thermostat chamber 23.

In the present invention, the front wall 15 of the refrigerator is constructed with sufficient space for two control panels 16 and 17, which are located between the two refrigerator doors 13 and 14. Control panel 16 is provided with means for controlling the temperature level within the cool compartment 11, and control panel 17 is provided with means for controlling the temperature level within the freezer compartment 12.

Each control panel includes a fixed dial 18 and a rotatable knob 19, with attached indicator needle for manual selection of desired temperature levels within compartments 11 and 12 respectively. Each knob operates a thermostatic switch in an electrical circuit that activates a refrigerating mechanism all of which is well known in the art.

Temperature indicating gauges 29 and 30 in refrigerator doors 13 and 14 respectively indicate an existing temperature within each of the compartments 11 and 12, so that a person can determine whether or not to operate the control panels in order to raise or lower a temperature therewithin.

In the present invention the electro thermostatic elements 20, together with their emerging electric circuitry 21, are located behind the control panels 16 and 17, and housed in the temperature insulated chambers 22 and 23, which chambers are embodied in the refrigerator structure intermediate between the cool compartment 11 and the freezer compartment 12.

Apertures 25 and 27 are provided in the insulation 24 surrounding chamber 22 and 23. Aperture 25 is a connecting air passageway between chamber 22 and compartment 11. Aperture 27 is a connecting air passageway between chamber 23 and compartment 12.

The temperature communication from compartments 11 and 12 to chambers 22 and 23 respectively is established as indicated by arrows 26 and 28, and the sensitive thermostats housed in chambers 22 and 23 are accordingly enabled to perform their function of controlling the refrigerating cycle and maintaining desired refrigerator temperature levels in the manner hereinbefore indicated.

The apertures 25 and 27 may be fitted with grill type covering or other suitable covers.

Figure 4:
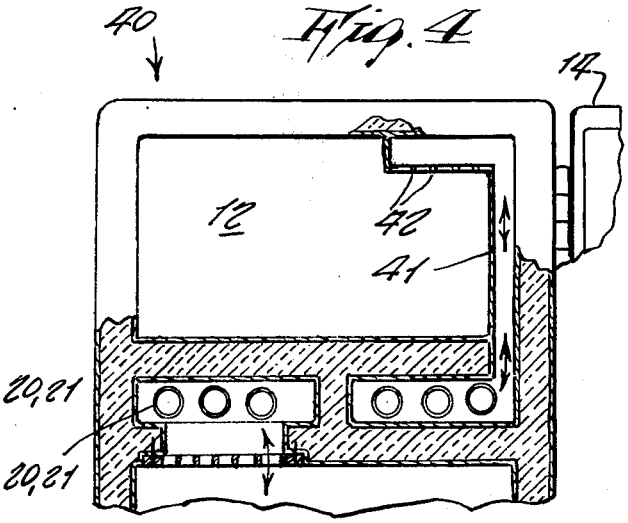
FIG. 4 is a view similar to FIG. 3, and showing a modified design wherein design electives are illustrated for the location of cold air apertures inside the refrigerator, and leading to the chamber which houses the therm electric mechanism.

Referring now to FIG. 4, it illustrates a refrigerator 40 which is a modified design generally similar to above designated refrigerator 10, except that chamber 23 is connected by means of an air passageway 41 with an aperture 42 opening into freezer compartment 12. Said aperture 42 may be conveniently located near the top area of compartment 12 as shown in FIG. 4, or in a low sidewall area of compartment 12, with a view of eliminating the possibility of water from melting ice during a defrosting cycle, descending into the chamber 23.

While certain novel features of this invention have been shown and described and are pointed out in the annexed claims, it will be understood that various omissions, substitutions and changes in the form and details of the device illustrated and in its operation can be made by those skilled in the art without department from the spirit of the invention.

What is claimed is:

1. In a refrigerator incorporating exterior temperature control means, the combination of a refrigerator having a cool compartment and a freezer compartment, a front door for each said compartment, a control panel for each said compartment located on an exterior wall of said refrigerator, each said control panel including a fixed, temperature calibrated dial with rotatable knob having an attached indicating needle, constituting means to select and maintain a desired temperature level for its respective compartment in conjunction with a thermo electric mechanism, a temperature insulated space embodied in the refrigerator, convenient to the cool compartment and freezer compartment thereof, said space divided into two chambers, temperature insulated from each other, said chamber housing an externally controlled thermostatic element, each chamber having an air conduit, opening into its respective compartment.

2. The combination as set forth in claim 1 wherein a temperature guage is mounted on each said door, such guages being readable from exterior of the refrigerator and indicating the temperature inside each said compartment.

3. The combination set forth in claims 1 and 2 except comprising a refrigerator having a single compartment, either a freezer compartment of a cool compartment, with a single chamber, single control panel and its components, single thermo electric mechanism and temperature guage.

* * * * *